United States Patent [19]

Breuers et al.

[11] 4,228,995

[45] Oct. 21, 1980

[54] SORTING DEVICE

[75] Inventors: Theo P. C. Breuers, Venlo; Andreas T. Heijnen, Tegelen; Hendrikus J. J. van Soest, Helden, all of Netherlands

[73] Assignee: Oce'-van der Grinten N.V., Venlo, Netherlands

[21] Appl. No.: 539,542

[22] Filed: Jan. 8, 1975

[30] Foreign Application Priority Data

Jan. 21, 1974 [NL] Netherlands ..... 00758
Jan. 21, 1974 [NL] Netherlands ..... 00759

[51] Int. Cl.[3] ..... B65H 31/24

[52] U.S. Cl. ..... 271/292; 271/291; 271/297; 271/308

[58] Field of Search ..... 271/DIG. 2, 64, 173, 271/174, DIG. 9, 287, 291, 292, 297, 308; 270/58

[56] References Cited

U.S. PATENT DOCUMENTS

| | | | |
|---|---|---|---|
| 3,721,435 | 3/1973 | Zanders | 271/173 |
| 3,802,694 | 4/1974 | Post et al. | 271/173 |
| 3,848,868 | 11/1974 | Stemmle | 271/173 |

*Primary Examiner*—Robert W. Saifer
*Attorney, Agent, or Firm*—Albert C. Johnston

[57] ABSTRACT

Device for the assorted collection of sheets, comprising a transport track and bins situated along this track. The bins are provided with guide organs and each bin can be moved so that its guide organ protrudes into the track so as to guide a sheet into a bin. In the transport track the sheets are transported by means of belts running around a vacuum holddown device so as to hold the sheets onto the belts.

22 Claims, 11 Drawing Figures

SORTING DEVICE

The present invention relates to an apparatus for the assorted collection of sheets, of a type which comprises a series of bins, means for transporting the sheets to be assorted along a track, the bins being situated along this track, and guide organs which can selectively be brought into the path of movement of the sheets to be assorted, in order to transport a sheet into a pertaining bin.

An apparatus of that general type is known from U.S. Pat. No. 3,467,371. In this known apparatus the guide organs are formed by small mainly triangular plates fixed on a shaft rotatable between two positions. When the shaft is in one position a point of the small triangular plates protrudes into the track of movement of the sheets, causing a sheet to be guided off and to be transported into a bin by means of a roller. In order that the transport of the sheets from the track of movement to the bins will take place in a reliable way, it is necessary that the guide organs and the bins be precisely positioned relative to each other. Moreover, the construction of the guide organs and of the pertaining rollers is rather complicated, which results in rather difficult assembly.

The principal object of the invention is to provide an apparatus of the type mentioned above whereby the disadvantages mentioned are avoided.

This object is attained according to the invention, in that each bin of a number of the bins is provided with a guide organ that forms a unitary part of said bin, and each such bin is movable between two positions including a first position in which the guide organ protrudes into the track of movement of the sheets and a second position in which the guide organ is situated out of the track of movement of the sheets.

In the known apparatus described in the above mentioned patent, the bins are installed generally horizontally and above one another in groups each of which has a limited number of bins, and each group of bins has its own track of transport which is joined to a common track of transport. This makes the construction very complicated and the apparatus difficult to inspect and maintain.

Therefore it is also an object of the invention to provide an apparatus of the type mentioned above, which is of a simpler construction than the known apparatus.

This object is attained according to a feature of the invention, which consists in that the means for transporting the sheets form an endless track having a rising part and a descending part, and in that the receiving trays are arranged in two groups, each consisting of bins installed at least partially above each other, so that the first group lies beside the rising part of the track of transport and the second group lies beside the descending part of the track of transport. By constructing the transport organ as a common organ for the two groups of bins a considerably simpler construction is obtained.

Preferably the means for transporting the sheets comprise a suction box, in which an underpressure can be maintained, and a number of mutually parallel endless belts which are movable about this suction box; and at least in the track parts where bins are situated, at the locations of interspaces between the belts, openings are made in the underlying wall or walls of the suction box.

According to another feature of the invention, a sheet reversing device is installed in the track of transport of the sheets at the location of the transition from the rising part to the descending part. Thus it is achieved that sheets are always deposited in a bin with the same sheet side upwards, whether the bin forms part of the first group or of the second group.

Other characteristics and advantages of the invention will become clear from the following description of an illustrative embodiment, wherein reference is made to the accompanying drawings in which.

Figure 1:
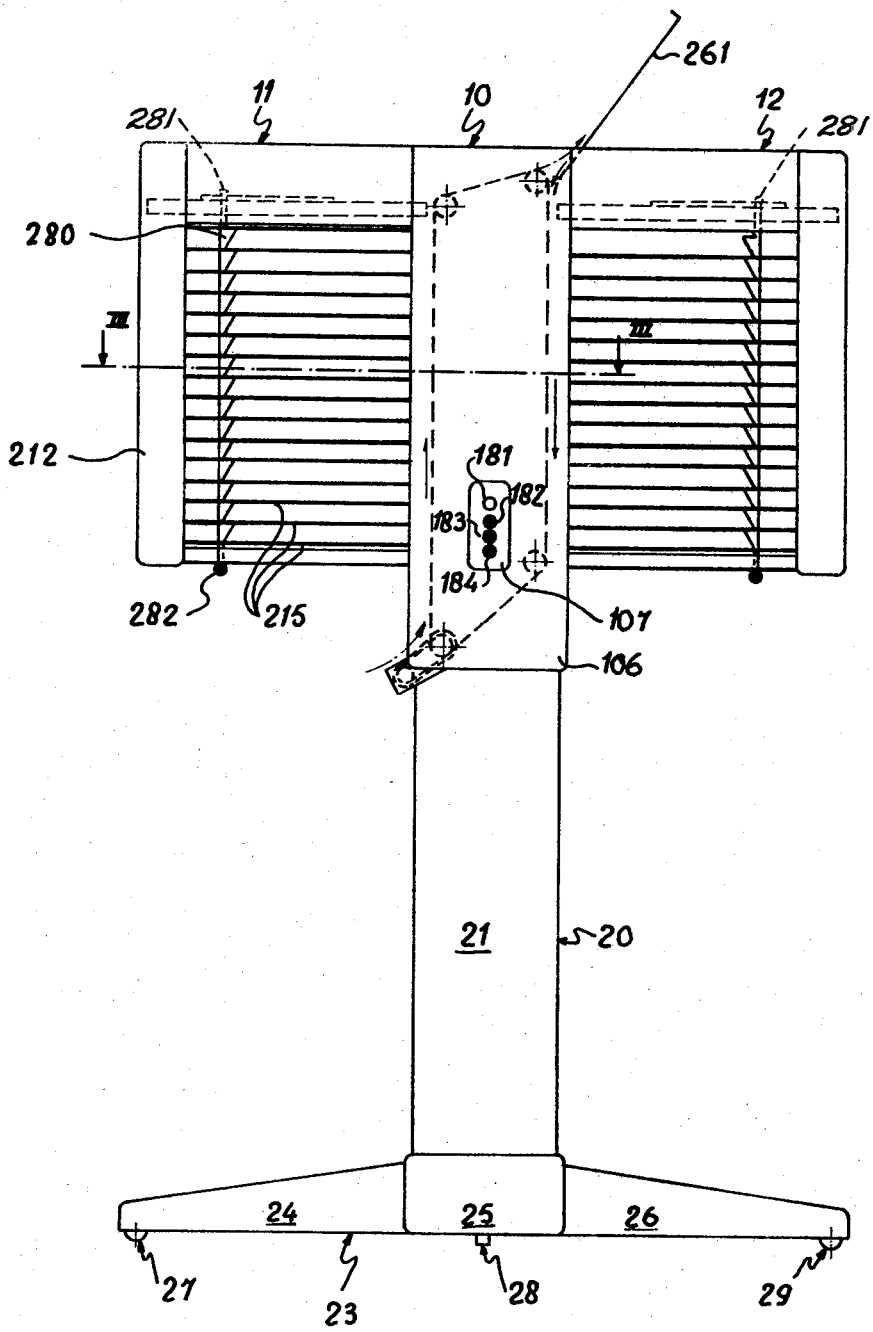
FIG. 1 is a front view of a sorting device according to the invention.
Figure 2:
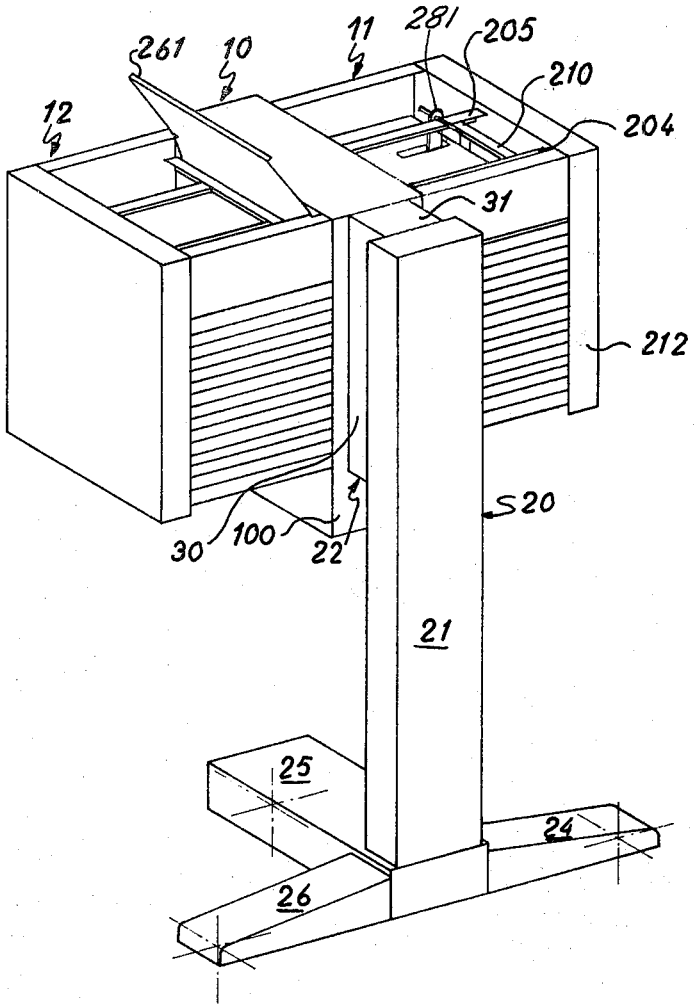
FIG. 2 is a schematic perspective rear view of the sorting device.

The sorting apparatus according to the invention as represented in FIGS. 1 and 2 mainly consists of a device 10 for transporting the sheets to be assorted, for instance copies, two sorting boxes 11 and 12 installed at either side of the transport device 10, in which boxes the receiving trays still to be described are installed, and the whole consisting of the transport device 10 and the sorting boxes 11 and 12 is sustained by a support 20.

This sorting apparatus can be used in combination with a copying apparatus, for instance an electrophotographic copying apparatus as described in Dutch patent applications Nos. 72 05491 and 72 14704, but it is also useful as a separate unit.

The support 20 consists of a vertical rectangular structural shape, or profile, 21, which rests on an underframe 23 consisting of three horizontal foot structures 24, 25 and 26, under which casters 27, 28 and 29 are installed. Against the upper part of the profile 21 a connecting structure 22 is mounted, consisting for instance of a U-shaped profile 30 which has its base plate fixed against the profile 21 and has fixed on its open side, as by welding, a plate 100 which forms part of the frame of the transport device 10. On the open ends of the U-shaped profile 30 plates 31 are installed.

The transport device 10 (see also FIGS. 3 and 4) comprises a frame which is formed by the plate 100, which forms the rear wall, two side walls 101 and 102 the rear edges of which are connected at screw holes 140 with the rear wall 100, and a front plate 103 which is formed by a metal plate bent in U-shape and fixed via its flanges against the side walls 101 and 102. Towards the front, the side walls 101 and 102 are lengthened by two plates 104 and 105 which are bent into L-shape and against which the front wall 106 of the transport device 10 is fixed. The front wall 106 supports an operation panel 107. Further, a covering plate 108, an upper plate 109 and a bottom plate 110 are fixed between the front wall 103 and the rear wall 100.

The plates 101, 102, 109 and 110 define a space 120 which in cross-section has a parallelepiped shape, and which is laterally closed off by the plates 100 and 103, and at the corners of this space rollers 111, 112, 113 and 114 are mounted rotatably in bearings provided in the plates 100 and 103. Further, a rope pulley 116 is fixed on the rear end of the shaft 115 of the roller 114, which pulley is connected via a rope 117 with a rope pulley 118 fixed on the shaft of an electromotor 119 located in the above-mentioned space 120. The rollers 111, 112, 113 and 114 have a number of relatively narrow endless belts 121, for instance six belts, arranged about them. Some flights of these belts extend outside the space 120 over almost the entire outer sides of the plates 101, 109 and 102, and the other flight extends inside the space 120 along the inner side of the bottom plate 110.

As an underpressure is to be prevalent in the space 120 during the operation of the apparatus, measures have been taken to minimize the quantity of air that can flow inwards via the junctions between the plates which form the space 120. Thus, as appears from FIG. 4, the upper extremity of the plate 101 is bent rectangularly, as well as the left extremity of the plate 109, and between the confronting edges of these two extremities a sealing element 122, for instance consisting of a foam rubber strip, is installed.

A sealing element 123 is also installed between the bent right extremity of the plate 109 and the bent upper edge of the plate 102. The respective lower edge portions of the plates 101, 102 are also bent, so that they partially extend behind the rollers 114 and 113, respectively, while the bottom plate 110 has a bent right extremity the edge of which extends substantially as far as the top of the lower edge portion of the plate 102, so that between these edge portions only a slit is left through which the belts 121 can pass.

Figure 5:
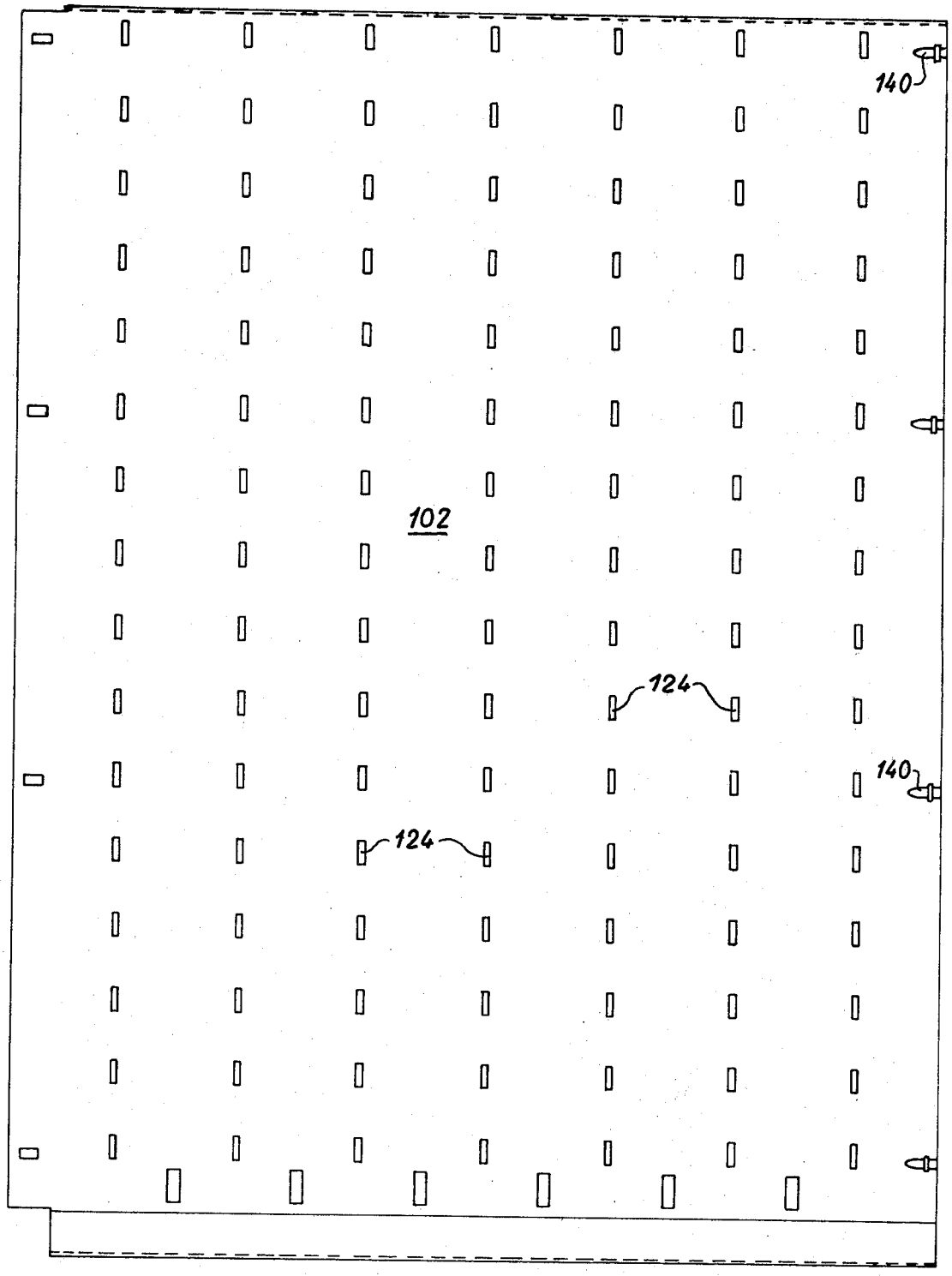
FIG. 5 is a view of a suction plate employed in the sheet transport means.

In each of the plates 101, 102 and 109 a number of groovelike openings 124 are made, as represented in FIG. 5 for the plate 102, at the locations of the interspaces between the belts 121. Further, slide strips 125 are fixed on the plates 101, 102 behind the belts, in order to keep the friction of the belts 121 extending over these plates as low as practicable.

Within the space 120 two ventilators 126 and 127 are installed with their air blowing ends opening outside the space 120. These ventilators maintain a certain underpressure within the space 120, so that an air stream directed inwards takes place by suction via the openings 124.

On each extremity of the shaft 115 of the roller 114 a plate 128 is installed rotatably, and the plates 128 are connected with each other by a plate 129 having fixed thereon two brackets 130 providing bearings in which a shaft 131 is mounted rotatably. Fixed on the shaft 131 is a roller 132 which has a number of rope grooves in its peripheral surface, and the roller 114 also has rope grooves formed therein at the locations of the interspaces between the belts 121. About the two rollers 114 and 132 a number of endless ropes 133 are installed. In the free extremity of at least one of the plates 128 a set screw 134 is installed, which can be screwed against the frame plate 100, so that the roller 132 can be fixed in different positions relative to the roller 116 by rotation about the shaft 115.

Further, a guide plate 135 is fixed between the frame plates 100 and 103 opposite to the upper plate 109 and along the outside of the belts 121.

The sheet transport device operates as follows: When the motor 119 is switched on, the belts 121 as well as the ropes 133 are driven via the roller 114, and when the ventilators 126 and 127 are switched on an underpressure is created within the space 120. When now a sheet, such as a copy, is supplied to the transport device, as schematically indicated by the arrow A (FIG. 4), this sheet is initially carried onwards by the rope 133 and is subsequently sucked against the belts 121 by the underpressure which is prevalent within the space 120.

The sheet is further carried onwards by the belts 121 and, except for some cases which will be explained afterwards in the description of the operation of the complete sorting device, is bent off at the location of the roller 111 via the plate 135 and is guided over the plate 109. At the location of the roller 112, the sheet comes loose from the belts, because here there is no suction, and the sheet arrives onto a reversing device 260 which will be described in greater detail below. When the sheet leaves the reversing device, it is anew sucked against the belts 121 and is moved downwards over the plate 102 until, maximally substantially at the location of the lower edge of the plate 102, it is removed from the belts as will be described further hereinbelow.

At either side of the transport device 10, the left sorting box 11 is installed opposite to the plate 101 and the right sorting box 12 opposite to the plate 102. The left sorting box 11 comprises a frame that includes two vertical L-shaped profiles 200 and 201 of which the respective upper extremities and the lower extremities are connected with each other by T-shaped profiles 202 and 203, respectively, which in the embodiment represented are each formed from two L-shaped profiles welded against each other. In a position vertical to the plane determined by the profiles 200, 201, 202 and 203, two L-shaped profiles 204 and 205 are welded against the T-shaped profile 202 and two L-shaped profiles 206 and 207 against the T-shaped profile 203. The profiles 204 and 206 respectively 205 and 207 are further connected with each other by vertical L-shaped profiles 208 respectively 209, while the profiles 204 and 206 respectively 205 and 207 are connected with each other by horizontal L-shaped profiles 210 and 211. A U-shaped protection plate 212 is fixed against the free extremities of the profiles 204 through 207.

The frame of the sorting box 11 is hinged to the connecting structure 22. For that purpose two brackets 213 are fixed against the flange plates of the profile 30, which brackets each support a hinge pin 214, and in the rear extremities of the profiles 202 and 203 holes are provided into which the pertaining pins 214 fit. In the active position of the sorting apparatus the frame of the sorting box 11 is in a position, the closed position, whereby the plane determined by the profiles 200, 201, 202 and 203 lies parallel to the plate 101, and a locking device (not represented) is provided to lock the sorting box in this position. The sorting box 11 can be turned away from the plate 101, clockwise as viewed in FIG. 3, in order to facilitate the elimination of any troubles in the transport of the sheets. In the sorting box 11 a number of horizontal receiving trays 215 are installed, which are movable mainly in a horizontal plane between two positions. Each receiving tray comprises a U-shaped profile, having a bottom plate 216, an upright front wall 217 and an upright rear wall 128. The bottom plate 216 has a mainly rectangular shape and has two lateral recesses 219 and 220, which facilitate the removal of assorted sheets.

For reinforcement, ribs 221 lying perpendicular to the front and rear walls 217 and 218 are formed in the bottom plate 216, while oblong openings 222 are provided between the ribs 221 and parallel to them. The purpose of these openings will be described below.

Against the upright front wall 217 of all but one of the trays 215 a scraping organ 223 is fixed. Each scraping organ 223 comprises a U-shaped profile 224 which is clamped onto an upright front wall 217. One of the U-legs of the profile 224 is extended to the other side of the body piece over the full length of the scraping organ 223, forming a flange 225, and over the length of the profile scraping blades 226 are formed at certain mutual distances. These blades mainly consist of small plates formed perpendicularly on the profile in the form of oblique-angled triangles one side of which coincides with the body piece of the U-shaped profile 224. In the case of the left sorting box the free, acute angle of each scraping blade 226 is directed downwards.

A small triangular plate 227 (FIG. 3) is fixed to each extremity of each scraping organ 223. This plate 227, for instance, is integral with the scraping organ 223, or it is fixed against the scraping organ 223 by any known technique. A pin 228 is provided on that side of each small plate 227 which faces away from the scraping organ 223, by which pin the receiving tray can be connected swingably with the frame of the sorting box, as described more particularly below.

The upright rear wall 218 of the receiving tray 215 also has a U-shaped profile 229 fixed thereto by being clamped thereon. In the embodiment shown this profile is shorter than the scraping organ 223. On the free or outer side of the profile 229 two triangular brackets 230 are formed at the center and as extensions of the U-legs of the profile. These brackets face each other, and their sides directed towards each other are provided with recesses lying opposite to each other, which receive the shaft ends of a small roller 231. The small roller 231 cooperates with a cam disk by which the receiving tray 215 can be moved between two positions as described more particularly below.

Near each extremity thereof, each profile 229 has a console 232 formed on its side facing away from the receiving tray, and the two consoles 232 of a same profile 229 have flanges which face towards each other. On each of these flanges a pin 233 is formed by which the receiving tray 215 can be connected swingably with the frame of the sorting box 11.

In the illustrated embodiment of the receiving tray 215, the tray itself is made of metal, such as aluminum, while the scraping organ 223 and the profile 229 are made of plastic, for instance by injection molding. However, the tray 215 and the profiles 223 and 229 can also be made completely of metal, and according to another embodiment the receiving tray 215 and the profiles 223 and 229 are manufactured as one plastic whole, for instance by injection molding. In the latter case the body pieces of the profiles 223 and 229 are integral with the upright walls 217 and 218, respectively.

Figure 6:
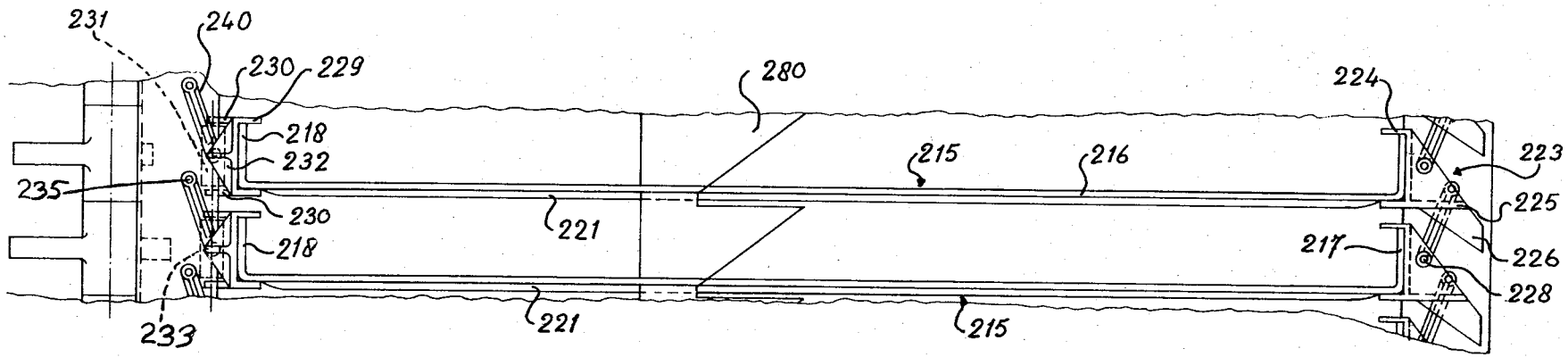
FIG. 6 is a side view of a number of bins or receiving trays and of means for effecting the suspension of these receiving trays in the sorting device.

As previously stated, the receiving trays 215 are provided with oblong openings 222 which, for the various receiving trays 215 in the sorting box, lie one above another. Through each series of superimposed openings 222 a bar 280 is inserted, which bar extends over substantially the full height of the sorting box. In principle, each bar can be smooth, but, as represented in FIGS. 1 and 6, bars 280 preferably are used which have a saw-toothed edge at the side directed towards the plate 101 and have the smallest sections between their teeth aligned with the bottom plates 216 of the receiving trays 215. The upper extremities of the bars 280 are connected with each other by a rod 281 which rests freely on the profiles 204 and 205, so that the whole assembly consisting of the bars 280 and the rod 281 can easily be displaced along the openings 222 in perpendicular direction relative to the walls 217 and 218. The lower extremities of the bars 280 may also be connected with each other by means of a relatively heavy rod 282 (FIG. 1), so that the bars will not be displaced too easily. The bars 280 are positioned so that during the operation of the apparatus the distances between the bars 280 and the front edge 217 are slightly greater than the length of the sheets to be laid down in the receiving trays. By means of the bars 280 the leading edges of the sheets laid down in a receiving tray 215 are caused to lie substantially in register, and not across one another.

Figure 9:
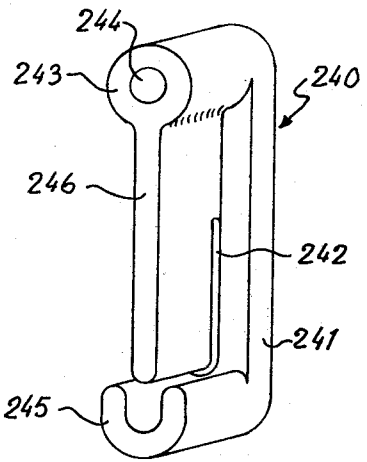
FIG. 9 is a perspective front view of an element of the means shown in FIG. 6 for suspension of the receiving trays.

For suspending the receiving trays swingably in the sorting box, links such as the link 240 represented in FIG. 9 may be used. The link 240 comprises an oblong body piece 241 provided with an oblong groove 242 which extends in the lower part of the link. A bushing 243 formed on the upper extremity of the body piece is provided with a central hole 244. A troughlike addition 245 is formed on the lower extremity of the body piece, with its upper edges ending substantially at the level of the lower extremity of the groove 242 and its trough having a semicircular cross-section. From the lower extremity of the bushing 243 a flange 246 extends downward, which flange is also connected with the body piece 241 up to the upper extremity of groove 242. The flange 246 ends substantially at the level of the upper edge of the troughlike addition 245.

The flanges of the profiles 200, 201 and 208 and 209 that lie perpendicular to the plate 101 are each formed with a number of holes therein, which lie above and at uniform distances from each other. These holes have pins 235 fixed therein; for instance, solid pins may be force fitted into the holes, but, preferably, tightening pins are used which are clamped in the holes in the said flanges so that respective parts of the pins 235 protrude inwards and towards each other near the profiles 200 and 201, and protrude towards and away from each other near the profiles 208 and 209. The hole 244 of a link 240 is shoved onto the protruding part of of each pin 235, having been made for slide-fitting onto the pin. Thus, the links 240 can pivot about the pins, while the body piece 241 of each link lies against a profile flange. Further, the holes in the flanges of the four profiles are located so that at each level four holes and four pins therein lie in a common plane. Thus, four links slid onto the four pins 235 are suspended planularly. The pins 228 and 233 of a receiving tray are supported in the troughlike additions 245 of these four links. For seating a pin 228 or 233 into the trough of a link 240, the related link flange 246 is deflected sidewards. When the pin is in place and the flange 246 is released, the flange returns to a position above the troughlike addition 245. The pins 228 and 233 thus are confined so that they cannot suddenly come loose from the links 240.

In this way, in the illustrated embodiment, fifteen receiving trays, all positioned horizontally and one above another, are installed in the left sorting box, with the scraping organ of each receiving tray lying opposite to the plate 101, and the scraping blades thereof lying opposite to the interspaces between the belts 121.

By reason of the swingable suspension of the receiving trays, and while there are no external forces acting on them, all receiving trays will occupy a position of rest, namely their lowest position, which is chosen in such a way that the points of their scraping blades 226 lie at a distance away from the belts.

Figure 8:
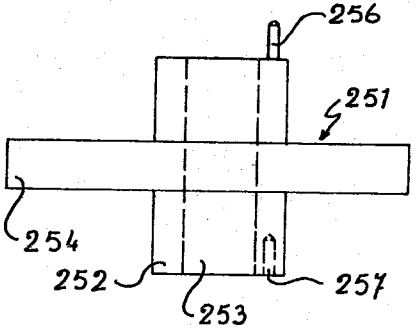
FIG. 8 is a side view of the same cam.
Figure 7:
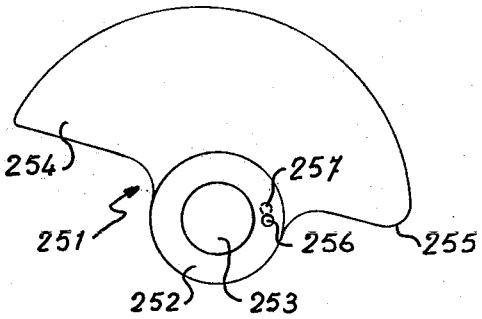
FIG. 7 is a plan view of the upper side of a cam to be used for controlling the movement of the receiving trays.

In the space between the plate 212 and the profiles 229 of the receiving trays 215 a vertical shaft 250 is installed, which at its lower end is rotatably mounted in a cross connection between the profiles 206 and 207 and at its upper end is rotatably mounted in a cross connection between the profiles 208 and 209. The upper end of the shaft 250 is coupled with the drive shaft of an electromotor, for instance a step motor, and a number of cams 251, each of the form represented in FIGS. 7 and 8, are fitted onto the shaft 250.

Each cam 251 comprises a bushing 252 having a central hole 253 to receive, and enabling the cam to be shoved over, the shaft 250. A cam disc 254 is formed on the bushing and has a profile as represented in FIG. 7. That is, no cam disc is present over approximately a half of the circumference, while from its extremity 255 the cam disc has a radius which gradually increases over approximately the other half of the circumference.

On the upper side of each bushing 252 a pin 256 is formed, and in the lower side of each bushing 252 a cylindrical recess 257 having nearly the same diameter as the pin 256 is formed. The pin 256 and the recess 257 lie on planes radial to the shaft 250 which include an angle of for instance 15°. The cams 251 are shoved onto the shaft 250 in such a way that the recess 257 of each cam engages over the pin 256 of the nearest lower cam, so that two successive cams are offset over the above-mentioned angle of 15°.

The dimensions of the bushings 252 are chosen so that the cam discs 254 lie opposite to the small rollers 231. However, at the level of the lowest receiving tray no cam is installed, but instead, for instance, only a spacing bushing, as will become clear in the description of the operation.

Figure 3:
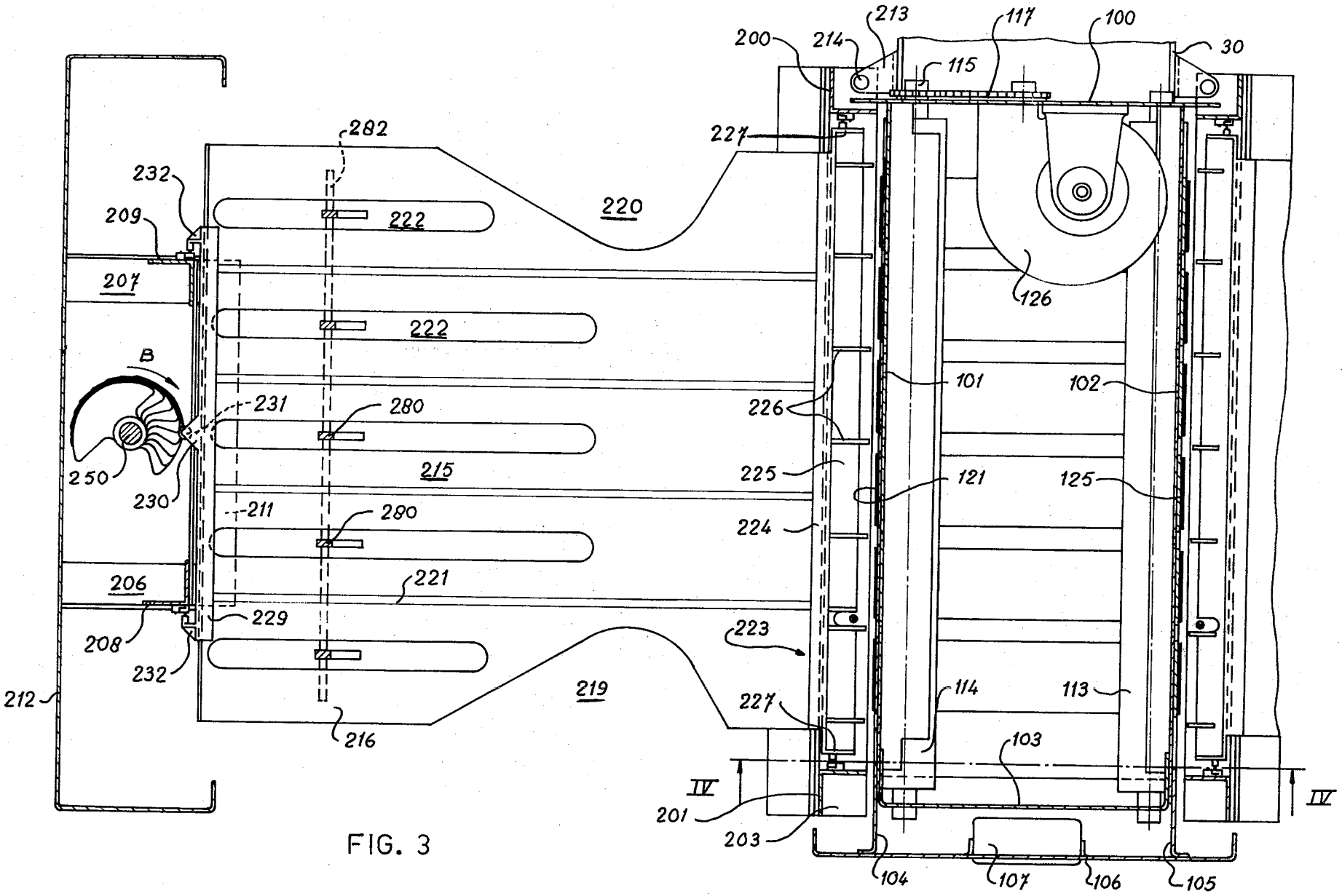
FIG. 3 is a section of a part of the sorting device, taken along the line III—III in FIG. 1.

The relative dimensions are chosen in such a way that upon a rotation of the shaft 250 in the direction of the arrow B in FIG. 3, a cam disc first contacts the pertaining small roller 231 with the cam part 255 having the smallest radius. Upon further rotation the cam disc will push against the roller concerned, so that the receiving tray is moved into the direction toward the plate 101. When that part of the cam disc 254 which has the greatest radius is pushing against the roller 231, the receiving tray will have been displaced so far in the direction of the plate 101 that the points of the scraping blades on the tray extend between the belts 121.

Figure 11:
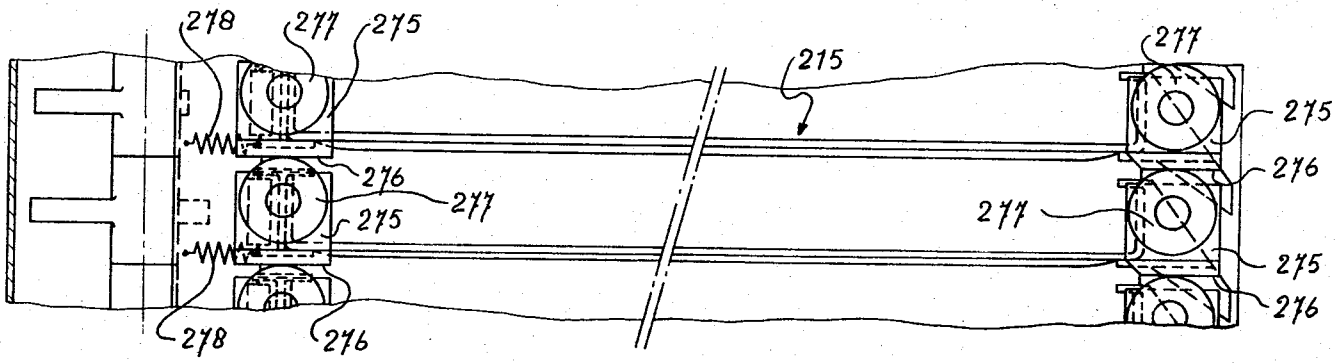
FIG. 11 is a side view of a number of receiving trays having a modified construction for suspension of the trays.

FIG. 11 illustrates another embodiment of structures suitable for the suspension of the receiving trays 215. In this embodiment both the front upright wall 217 and the rear upright wall 218 of the receiving tray are provided at either extremity with a plate 275. Each plate 275 has a horizontal flange 276 formed on its lower side. A freely rotatable roller 277 mounted in each plate 275 is arranged so that this roller can cooperate with the flange 276 of the plate 275 which belongs to the next higher receiving tray. The extremities of the rear upright edge 218 also have springs 278 fixed thereto, and the other ends of these springs are connected with the profiles 208 and 209 so that the receiving trays are always being pulled to the left as viewed in FIG. 11.

Figure 4:
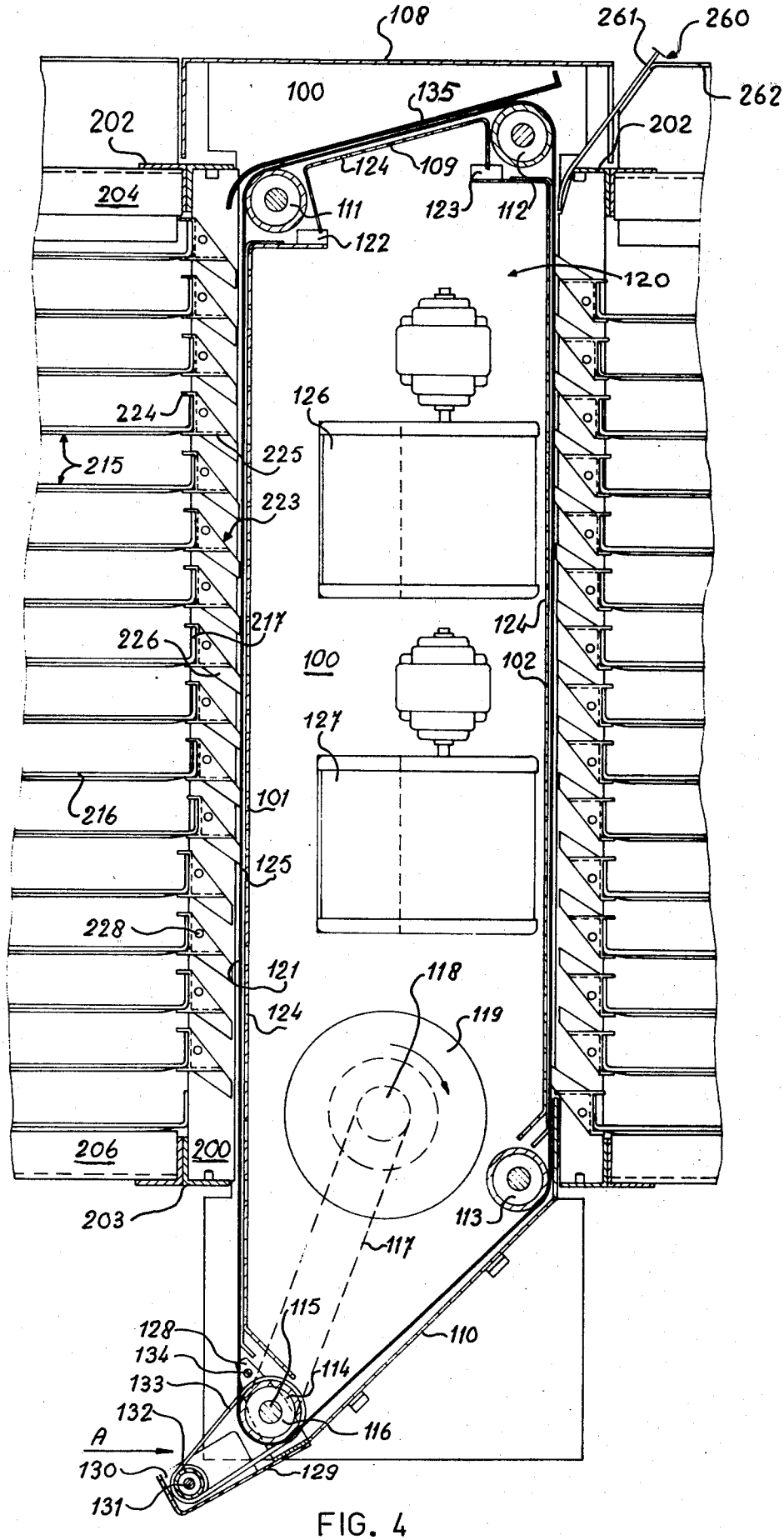
FIG. 4 is a section of a part of the sorting device, taken along the line IV—IV in FIG. 3.

The operation of the transport device 10 together with the left sorting box is as follows: When a sorting run starts, the cam shaft 250 is in a zero position at which it is turned so that the lowest but one receiving tray 215 is displaced as far as possible in the direction toward the plate 101. As previously stated, the lowest receiving tray is not displaceable and moreover that tray, as represented in FIG. 4, may be firmly installed in the frame. When now via the ropes 133 and the belts 121 a sheet is supplied, this sheet will be deflected away from the belts 121 by the points of the scraping blades 226 of the lowest but one receiving tray, which points protrude between the belts 121, and will be guided off beneath the blades in such a way that the sheet will be transported into the lowest receiving tray. If the following sheet is to be deposited into the lowest but one tray, the shaft 250 is turned through an angle of for instance 15°, as a result of which the cam disc of the lowest but one receiving tray no longer engages the roller of the pertaining receiving tray, which tray returns to its rest position where the points of its scraping blades lie at a distance away from the belts. As another result of the turning step of the shaft, the lowest but two receiving tray is now displaced by its cam as far as possible in the direction of the plate 101, so that the points of its scraping blades 226 protrude between the belt 121 and cause the following copy sheet supplied via the transport device 10 to be deposited into the lowest but one tray. If the next following sheet is to be deposited into the lowest but two receiving tray, the shaft 250 is anew turned through 15°, etc.

When at a certain moment it is desired to deposit the following sheet again into the lowest tray, the shaft 250 is turned so far that again the zero position described above is reached, and the run can start once more.

As appears from FIG. 1, sixteen receiving trays are represented in the left sorting box, wherein the lowest receiving tray is not provided with a scraping organ, while the uppermost receiving tray is not active as such but only serves to make it possible to transport a copy sheet into the highest but one receiving tray. The same applies if receiving trays according to FIG. 11 are used.

When more than fifteen sorting trays are needed, the right-hand sorting box 12 is available for that purpose. The sorting box 12 differs in only a few details from the sorting box 11. Only these details will be described below, and for the same parts the same references will be used.

The description already given of the operation of the transport device 10 mentioned that when a sheet arrives at the height of the roller 112, the sheet is further transported to a sheet reversing device. This is desirable because otherwise the sheet would be laid down with the wrong side upwards in the receiving trays of the sorting box 12.

The sheet reversing device 260 consists of a guide organ 261, for instance a thin metal plate or a grate, mounted at an angle of for instance 50° to the horizontal. This guide organ 261 is fixed against the profile 202 of the sorting box 12, and further rests on the upper plate 262 of the sorting box 12. The dimensions of the plate 261 are greater than the greatest dimensions of a sheet to be assorted. The operation of the reversing device 260 is as follows: When a copy sheet has arrived at the height of the roller 112, it cannot follow the rather sharp bend which the belts make at this location, and it will be further transported almost horizontally until its leading edge pushes against the guide organ 261. Here this leading edge will be guided upwards, and the sheet will be pushed further upwards along the guide organ. This is continued until the rear edge also comes loose from the roller 112, whereupon as a result of the speed and gravity, the sheet is brought slightly further onto the guide organ and will fully rest on it. Subsequently the sheet slides downwards along the guide organ 261, until the edge which previously had been trailing is sucked against the belts 121 by the suction through the openings in the plate 102 and is now taken along by the belts as the leading edge. From then on, the further transport is identical to the transport along the plate 101.

Figure 10:
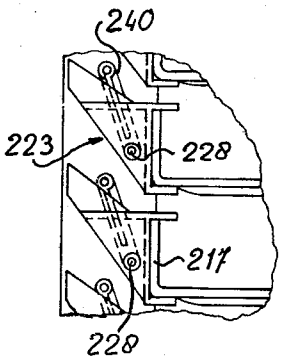
FIG. 10 is a fragmentary view of means for the suspension of a number of receiving trays.

Another structural difference between the left and right sorting box lies in the installation of the scraping organs which indeed are identical for the two sorting boxes but which in the right sorting box have their points directed upwards, as represented in FIG. 10. Consequently, when a receiving tray has been fully displaced in the direction toward the plate 102, the sheets are deposited into this same tray, and not into the nearest lower tray as in the left sorting box. Further, the uppermost receiving tray falls away in the right sorting box, while in the embodiment represented the lowest receiving tray is fixed in a position where its scraping blades protrude between the transport belts 121 so that all sheets which have not been deposited into one of the preceding trays are collected in it.

It will be apparent that the invention is not restricted to the embodiment herein described and illustrated, and that numerous modifications can be made without deviating from the concept of the invention. For example, the receiving trays can be constructed in other ways, as well as the reversing mechanism 260. Further, it is possible to couple together more of the sorting devices, for instance by also installing the lowest receiving tray in the right sorting box so that it is displaceable and installing a transport mechanism below this tray, to which mechanism a following sorting device of the same type is joined. Further, it is not necessary that the receiving trays be installed horizontally. More particularly, for instance, receiving trays installed at an angle to the horizontal may be used, with the scraping organs and the transport mechanism for the sheets being situated on and near their upper extremities. Also other arrangements within the scope of the invention are possible.

We claim:

1. Apparatus for the assorted collection of sheets, comprising means for transporting sheets to be assorted successively along a sorting track, a group of bins situated along a side of said track, and guide organs movable selectively into said track and each operative therein to divert a sheet therefrom into a pertaining bin, characterized in that each bin of a plurality of said bins has a guide organ unified therewith and is movable to and fro relative to said track and independently of the other of said bins between two positions in a first of which the guide organ on the bin is situated out of the path of movement of a sheet in said track and in the second of which said guide organ protrudes into said path to divert a sheet from said track into one of said bins.

2. Apparatus according to claim 1, said track extending substantially vertically with the bins of said group superposed beside it, said transporting means being operative to move the sheets upwardly in said track, and the said guide organ on a said bin in said second position being operative to divert a sheet from said track into the next lower bin of said group.

3. Apparatus according to claim 1, said track extending substantially vertically with the bins of said group superposed beside it, said transporting means being operative to move the sheets downwardly in said track, and the said guide organ on a said bin in said second position being operative to divert a sheet from said track into its own bin.

4. Apparatus according to claim 1, said first position of each said bin being a normal rest position thereof which the bin occupies when not being displaced toward said track.

5. Apparatus according to claim 4, each said bin having wheels thereon which are rollable on surface portions of an adjacent bin of said group for movement of the bin between said positions.

6. Apparatus according to claim 4, and including a frame having parts at opposite sides of said group of bins, each said bin being connected with said frame parts by links each of which is hinged at one end thereof to the bin and hinged at its other end to one of said frame parts.

7. Apparatus according to claim 1, said transporting means comprising an upright wall bordering said track, a plurality of substantially parallel belts spaced apart on and movable along said wall, openings in said wall at locations between said belts, and means for drawing air through said openings to hold a sheet against said belts by suction.

8. Apparatus according to claim 1, and means for displacing said movable bins in succession, each to its said second position and thereafter back to its said first position, at intervals such that sheets being transported successively along said track are deposited into respective successive bins.

9. Apparatus according to claim 1, said track extending substantially vertically with the bins of said group superposed beside it, said bins being constituted by trays which are disposed mainly horizontally and have in their respective bottoms oblong openings aligned vertically from tray to tray, the respective sets of said aligned openings having bars extending therethrough in position to be engaged by the leading edges and thus to form even piles of the sheets being deposited into said trays.

10. Apparatus according to claim 9, each of said bars having a saw-toothed form whereby it presents in each of said trays a sloped surface to be engaged by the leading edges of sheets deposited in the tray.

11. Apparatus according to claim 1, said transporting means forming an endless track having a rising sorting part and a descending sorting part, there being two groups of said bins including a first group of superposed, mainly horizontally disposed bins lying beside said rising part and a second group of superposed, mainly horizontally disposed bins lying beside said descending part.

12. Apparatus according to claim 11, said endless track comprising a mainly horizontal transition part between the upper ends of said rising part and said descending part and a return part between the lower ends thereof.

13. Apparatus according to claim 11, said transporting means comprising a suction box having upright walls bordering said track parts and a plurality of substantially parallel endless belts which are mutually spaced apart and are movable about said box on and along the outer sides of said walls, said walls having openings therethrough in the spaces between said belts, and means for maintaining a reduced air pressure in said box whereby a sheet in either of said track parts will be held against said belts by suction through said openings.

14. Apparatus according to claim 11, and means at an upper part of said endless track for reversing the position of each sheet being transported between said rising part and said descending part.

15. Apparatus according to claim 11, said endless track including a transition part extending between the upper ends of said rising part and said descending part and which makes ahead of the latter a sharp bend in the track whereby each sheet being transported over said bend is directed out of said track, and a guide member lying obliquely at a location beyond said bend to receive each sheet so directed and then to deliver the sheet with its originally trailing edge downward, so in reversed position, to an upper portion of said descending part.

16. Apparatus for the assorted collection of sheets, comprising a suction box having upright walls at opposite sides thereof and a top wall extending between said upright walls, a plurality of substantially parallel endless belts which are mutually spaced apart and are movable about said box on and along the outer sides of said walls to define with them a track including a rising track part and a descending track part respectively along said upright walls and a mainly horizontal transition part along said top wall, and walls having openings therethrough in the spaces between said belts, means for maintaining a reduced air pressure in said box whereby a sheet brought to said track will be transported therealong by being held against said belts by suction through said openings, first and second groups of trays positioned, respectively, beside said rising track part and said descending part, each of said groups comprising a multiplicity of superposed, mainly horizontal trays each of which has a guide organ thereon and is movable to and fro relative to said track, and independently of the other trays of the group, between two positions in a first of which the guide organ on the tray is situated out of the path of movement of a sheet in said track and in the second of which said guide organ protrudes into said path to divert a sheet from said track into one of said trays, said first position of each said tray being a normal rest position thereof which the tray occupies when not being displaced toward said track, the said guide organ on any tray of said first group in said second position being operative to divert a sheet from said track into the next lower tray of said group and the said guide organ on any tray of said second group in said second position being operative to divert a sheet from said track into its own tray, and means for displacing said trays of each said group in succession, each to its said second position and thereafter back to its said first position, at intervals such that sheets being transported successively along said track are deposited into respective successive trays.

17. Apparatus according to claim 16, the trays of each of said groups having in their respective bottoms oblong openings aligned vertically from tray to tray, the respective sets of said aligned openings having bars extending therethrough in position to be engaged by the leading edges and thus to form even piles of the sheets being deposited into said trays.

18. Apparatus according to claim 27, said transition part making ahead of said descending track part a sharp bend whereby each sheet being transported over said bend is directed out of said track, and a guide member lying obliquely at a location beyond said bend to receive each sheet so directed and then to deliver the sheet with its originally trailing edge downward, so in reversed position, to an upper portion of said descending part.

19. A sorting apparatus comprising:

a plurality of sheet receiving bins, each of said bins including a member for supporting sheets in said bin;

means for transporting a sheet past each of said bins;

each of said members including an integral means for deflecting a sheet from said transport and guiding said sheet into one of said bins; and means for supporting said members for movement selectively between a first position wherein said deflecting means is operative to deflect and guide a sheet from said transport into a bin and a second position wherein said deflecting means is inoperative to deflect and guide a sheet from said transport into a bin.

20. An apparatus as in claim 19, wherein said sheet supporting members are pivotally supported at one end and said deflecting and guiding means are arranged at the opposing end.

21. An apparatus as in claim 19, wherein said deflecting means is arranged to guide a sheet onto the member with which said deflecting means is integral.

22. An apparatus as in claim 19, wherein said deflecting means is arranged to guide a sheet onto a member next adjacent to the member with which said deflecting means is integral.

* * * * *